US005634326A

United States Patent [19]

Wanger

[11] Patent Number: 5,634,326

[45] Date of Patent: Jun. 3, 1997

[54] SPINDLE FOR GAS BEARING OF A RAPIDLY ROTATING TOOL, IN PARTICULAR FOR AEROSTATIC BEARING OF AN OPEN-END SPINNING ROTOR

[76] Inventor: Gerhard Wanger, Groblellenfeld 100, D-91722 Arberg, Germany

[21] Appl. No.: 563,629

[22] Filed: Nov. 28, 1995

[30] Foreign Application Priority Data

| | | | |
|---|---|---|---|
| Nov. 29, 1994 | [DE] | Germany | 44 42 384.5 |
| Aug. 3, 1995 | [DE] | Germany | 195 28 452.6 |
| Oct. 17, 1995 | [DE] | Germany | 195 38 624.8 |

[51] Int. Cl.[6] ..... D01N 4/00

[52] U.S. Cl. ..... 57/406; 57/135; 384/107

[58] Field of Search ..... 384/107; 57/406, 57/407, 134, 135

[56] References Cited

U.S. PATENT DOCUMENTS

| | | | |
|---|---|---|---|
| 2,603,539 | 7/1952 | Brewster | 384/107 |
| 3,481,129 | 12/1969 | Shepherd et al. | 57/406 |
| 3,595,002 | 7/1971 | Koritysky et al. | 57/406 |
| 3,875,732 | 4/1975 | Ellingham | 57/406 |
| 4,519,205 | 5/1985 | Gubler | 57/406 |
| 4,875,334 | 10/1989 | Rajsigl et al. | 57/406 |
| 5,073,036 | 12/1991 | Sutton et al. | 384/107 |
| 5,073,037 | 12/1991 | Fujikawa et al. | 384/107 |
| 5,426,931 | 6/1995 | Beitzinger et al. | 57/406 |
| 5,450,718 | 9/1995 | Knabel et al. | 57/406 |
| 5,522,211 | 6/1996 | Knabel et al. | 384/107 |

FOREIGN PATENT DOCUMENTS

| | | |
|---|---|---|
| 2349072 | 3/1975 | Germany . |
| 2525435 | 10/1976 | Germany . |
| 7611594 | 6/1979 | Germany . |

*Primary Examiner*—William Stryjewski

*Attorney, Agent, or Firm*—Steinberg, Raskin & Davidson, P.C.

[57] ABSTRACT

A spindle for gas bearing of a rapidly rotating tool, in particular for aerostatic bearing arrangement of an open-end spinning rotor, including a spindle housing, a rotatable elongate shaft supported in the spindle housing in a radial direction of the shaft by a radial gas bearing element and an elongate extension rod. The rotor is coupled to the extension rod at a first end thereof. An extension rod bearing element is arranged at a region proximate the first end of the extension rod at which the rotor is attached. A first bearing clearance is defined between the radial bearing element and the shaft and a second bearing clearance is defined between the extension rod and the extension rod bearing element which is at least twice the first bearing clearance.

23 Claims, 6 Drawing Sheets

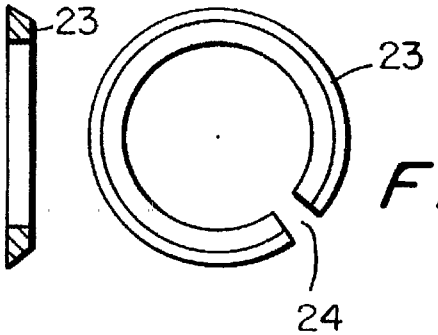
FIG. 4C
FIG. 4B
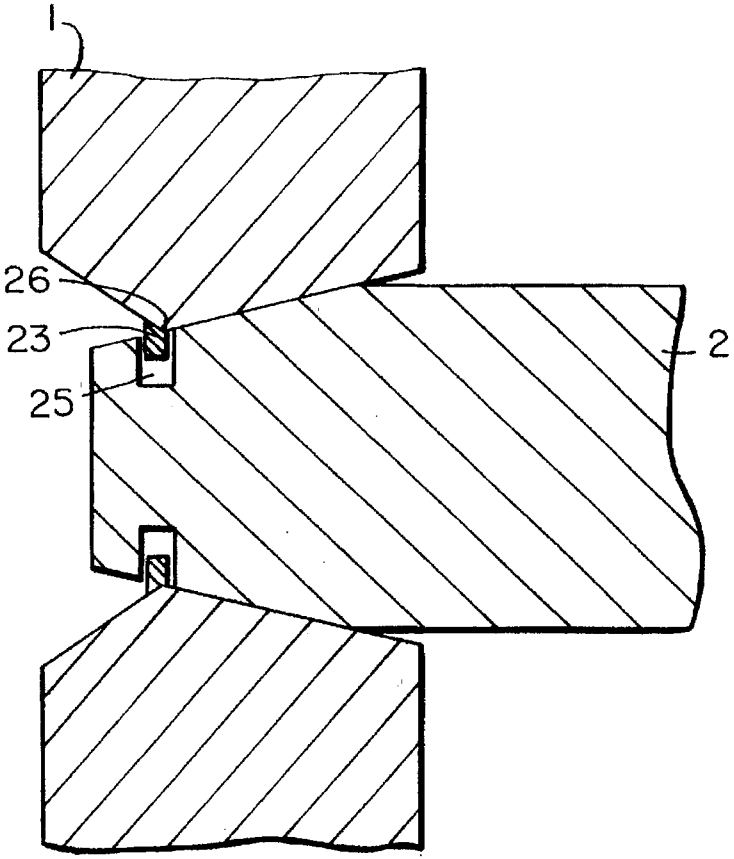
FIG. 4A

SPINDLE FOR GAS BEARING OF A RAPIDLY ROTATING TOOL, IN PARTICULAR FOR AEROSTATIC BEARING OF AN OPEN-END SPINNING ROTOR

FIELD OF THE INVENTION

The present invention relates to a gas bearing for a rapidly rotating tool, in particular an aerostatic bearing of a spinning rotor, which cannot be overloaded by the occurring forces, such as unbalancing forces, and which runs in the supercritical range.

BACKGROUND OF THE INVENTION

In the prior art, primarily a conventional and proven twin disk bearing (roller bearing) was used as the bearing of a spinning rotor. In this case, the spinning rotor is at the end of a shaft which runs between a drive belt and two rollers which have diameters at least 10 times greater than the diameter of the shaft and which are lined with rubber. In view of this translation ratio of 1:10, the life of the ball bearing could be extended considerably over that of a direct ball bearing of the spinning shaft, where a 10 times greater speed of the ball bearings is necessary. Nevertheless, the rollers and the ball bearings must be renewed approximately every 20,000 hours because of wear.

The twin disk bearing offers however clear advantages over earlier bearings. Specifically, since it is able to bear relatively great loads and because of the rubber lining on the rollers and the drive via a belt, the shaft with the spinning rotor runs in the supercritical range, so that the unbalance forces exerted upon the bearing are considerably lower. This bearing is described in detail in the document laid open to public inspection, German Patent Application No. DE 25 25 435 B1. In the apparatus described in this document, a support bearing (see column 4, uppermost paragraph) is also present, but in an entirely different context from that of the bearing designated at 4 and described in the claims.

Furthermore, in this connection the use of aerostatic bearings has often been tried, as no wear of the bearing occurs with them. As the document laid open to public inspection German Patent Application No. DE-AS 23 49 072 describes, the rotor is rigidly connected to the supported shaft in this case, and therefore this bearing is unable to support the high loads caused by unbalance in the spinning rotor when a yarn breakage occurs.

Where varnish atomization is used, for example, and in spite of the aerostatic bearing which is often used, rigid connection between the atomizer and the rotating shaft is still customary, so that low unbalance masses or a slightly eccentric seat of the atomizer on the shaft can already cause the aerostatic bearing to become overloaded. Since the ability of gas bearings to bear loads as compared to roller bearings of the same size is many times lower, their utilization was often not possible until now. Furthermore, even a slight overload of the gas bearing at high rotational speeds causes irreparable malfunction.

In addition to spinning rotors, a gas bearing is desirable also with other rapidly rotating tools. Such tools are for example the head of a varnish atomizers, the drum of a centrifuge and optical tools such as prisms, polygons etc. Instead of air, other gases can and should also be used for the bearing. The bearing should and can be static or dynamic.

OBJECTS AND SUMMARY OF THE INVENTION

A motivating object of the invention was thus to create a gas bearing for a rapidly rotating tool, in particular an aerostatic bearing of the spinning rotor, which cannot be overloaded by the occurring forces, such as unbalance forces, and which runs in the supercritical range. After many attempts, it was found that a wide bearing gap (in the range of 1/10 mm) is necessary for this; however this leads to high air consumption, so that the energy costs are unsustainable. Then a possibility was sought of ensuring supercritical bearing of the spinning rotor in spite of the narrow bearing gap (8–12 μm). Elastic suspension of the bearing rings (or bearing cups) in O-rings made it possible to obtain supercritical operation, but because the air bearing gap lies within the oscillation range and must therefore transmit the inertia compensation forces, the necessary absorption of unbalance forces could not be ensured in this case.

Supercritical suspension of the spinning rotor itself in the aerostatically supported shaft was considered then as a last possibility. For this, the spinning rotor was suspended on a freely oscillating extension (e.g., an extension rod) of such dimensions that it was possible already at low rotational speeds to pass through the first natural oscillation (oscillation resonance). The oscillation amplitudes when passing through the resonance were however so high that the aerostatic bearing was overloaded. A bearing at the end of the extension with sufficient clearance in order to make free oscillation of the extension in the supercritical range of rotational speed possible finally solved the problem. This bearing only becomes functional when the oscillation amplitudes at the end of the extension with the spinning rotor are greater than the clearance of the bearing. As soon as the spinning rotor runs in the supercritical range, contact between bearing and extension must be excluded, and for this, at least twice the bearing clearance of the aerostatic radial bearing is required for this bearing. With this suspension of the spinning rotor, it was possible to create an aerostatic bearing which cannot be overloaded by unbalance forces, in addition to the advantage of low wear.

In order to shorten the length of the spindle and bring the unbalance forces emanating from the spinning rotor closer to the aerostatic bearing, the oscillation-free extension is installed for the major part in a centered bore of the aerostatically supported shaft. To ensure that the extension passes through the first natural oscillations already at low rotational speeds, the length of the extension must be at least about four times the smallest diameter of the extension. Since the second natural oscillation of the extension must be far enough from the operating speed, the diameter of the extension must increase from the point of connection to the spinning rotor.

Attachment of the extension in the bore of the shaft represents another problem. At first threads were used, but this caused loosening due to settling phenomena in the threads after a certain time of operation because of the high dynamically alternating stress. A press fit was extremely costly because the pressing had to be produced with very narrow dimensional tolerances (about 5 to 10 μm) in order to prevent bending the extension because of excessive press forces. By providing threads on either the extension or the shaft, the insertion force could still be within acceptable ranges with wide dimensional tolerances of about 1/10 mm, without having to fear a bending of the extension.

Replacement of the spinning rotor must be possible also with aerostatic bearings. For this reason, a detachable connection between the shaft and spinning rotor was provided in the design up to now. However, this had as a consequence that the spindle had to be balanced again each time the spinning rotor was replaced, or a high-precision, expensive fit between shaft and spinning rotor had to be provided (tolerance field width of about 0.002 mm) because the unbalance exceeds the limit load of the aerostatic bearing even with slightly eccentric seating of the spinning rotor.

By providing the detachable connection at the end of the above-mentioned extension of the aerostatically supported shaft, the connection can be established with wider tolerance (about 0.05 mm), since it lies within the supercritical range of oscillation which is attained already at relatively low rotational speed.

In some applications, it was then necessary to provide a bore in the extension, through which something can be inserted (e.g., varnish, cotton fibers, etc.). For this, a certain minimum diameter is indicated here, and free oscillation is produced by ensuring that the wall of the extension is suitably thin between the press fit of the shaft and the bearing of the extension.

It was then found that an additional radial bearing at the free end of the drive element considerably increases the radial ability of the aerostatic bearing to bear loads. In order to continue providing a wear-free bearing unit, it is advisable to use an aerostatic bearing as the additional radial bearing. This centered arrangement of the drive element between the two aerostatic bearings leads to a load free of breakdown torque. For this reason, a uniform narrowing of the bearing gap is produced over the entire length of the bearing, and an advantageous distribution of pressure is created, enabling the aerostatic bearing to bear much greater loads.

For technical reasons in manufacture, it is advantageous to make the part of the shaft born or retained in the radial bearing at the free end of the drive element and the freely oscillating extension at the end of which the spinning rotor is attached, as a single integral part. In order to attach the portion of the shaft supported between the spinning rotor and the drive element to the rear portion of the shaft, an advantageous press-fit connection is provided near the drive element.

In one embodiment of the present invention, the two aerostatic axial bearing through which a flow goes from the larger bearing diameter to a smaller inside diameter are located at the end of the shaft. In order to reduce the friction of the radial bearing, the bearing diameter must be made smaller, and this created the problem that the axial bearing carried out auto-stimulated axial oscillations. For this reason, it is advantageous to provide a disk at one end of the shaft to serve as bilateral axial bearing of the shaft. Depending on the manufacturing or assembly process, it is advantageous for the shaft and the disk to be made in one piece, or to connect them to each other by means of a press-fit or welded connection.

By attaching a ring-shaped permanent magnet on one side, which is arranged to exert a force of attraction on the disk at the end of the shaft, one of the two aerostatic axial bearings can be omitted, and this may be an advantage in manufacture, depending on the configuration.

The pressure force of the belt against the drive element deforms the shaft. It was found that the aerostatic bearings offer the highest load capacity when the deformation of the connecting element of the bearing is adapted to the deformation of the shaft in the area of the drive element, since uniform narrowing of the bearing gap over the entire length of the bearing of the radial bearing in question is then ensured. To be able to achieve this, the two aerostatic bearings must be suspended individually in the spindle housing in such manner that they are able to assume an inclined position relative to the longitudinal axis of the spindle without meeting with resistance. Membrane-like elements or an elastic suspension by O-rings are suitable for this.

Since the diameter and the length of the drive element are prescribed in advance, the connecting element of the aerostatic radial bearing must be adapted in its geometric dimensions such as length, width and height so that the connecting element of the bearings and the drive element of the shaft have nearly the same deflection with a given load imposed by the pressure force of the belt.

In one embodiment of the invention, the detachable connection for the replacement of the spinning rotor is attached at the end of the freely oscillating extension. A special embodiment which makes it possible to replace the spinning rotor rapidly is now described here in greater detail.

A snap connection producing a connecting force through elastic deformation of the connecting element is especially well suited. A ring made of spring steel is a suitable elastic connecting element. In order to ensure clearance-free seating of the rotor, the connection point should be conical in form. A slit in the circumference of the ring provides for greater elasticity, so that more favorable manufacturing tolerances of the connection are possible. It is an additional advantage of this connection which uses a ring, that the centrifugal forces which occur cause the ring to widen, so that the connection is given additional holding strength in a dynamic state.

It was found to be useful to use the disk serving for an axial bearing in addition to brake the shaft. In such a case, by attaching a ring-shaped extension at the edge of the disk, a radial gap is formed together with the housing, whereby a liquid is pressed through a bore into the gap so that the liquid friction brakes the shaft hydrodynamically.

Another possibility consists in braking the disk by means of a ring-shaped brake lining which is attached in the housing and can be shifted. The pressure force for this brake lining may be produced mechanically, elector-magnetically or pneumatically. In a pneumatically actuated brake, the brake lining is suspended by O-rings in the housing so that a seal against the space in the housing which is supplied compressed air through a bore may be created. The resetting of the brake lining, achieved through the thrusting forces in the O-rings, is an advantage of this arrangement, so that the lining no longer rubs against the disk upon completion of the braking process.

In another embodiment, the shaft comprises a central bore in which the extension rod is situated and the extension rod is coupled to the shaft at an end opposite to the end at which the tool, e.g., spinning rotor, is attached. The extension rod is drilled at the shaft-coupling end and press-fit connection means are provided for attaching the drilled end of the extension rod to the shaft. A thickness of a wall of the extension rod increases in direction from the drilled end to the tool-attaching end.

BRIEF DESCRIPTION OF THE DRAWINGS

The following drawings are illustrative of embodiments of the invention and are not meant to limit the scope of the invention as encompassed by the claims.

FIG. 4A shows an embodiment of the snap according to the invention which is used to connect the spinning rotor to an end of an extension rod.

FIG. 4B is a cross-sectional side view of the ring shown in FIG. 4A.

FIG. 4C is a frontal view of the ring shown in FIGS. 4A and 4B showing the slit therein.

DETAILED DESCRIPTION OF THE PREFERRED EMBODIMENT

Figure 1:
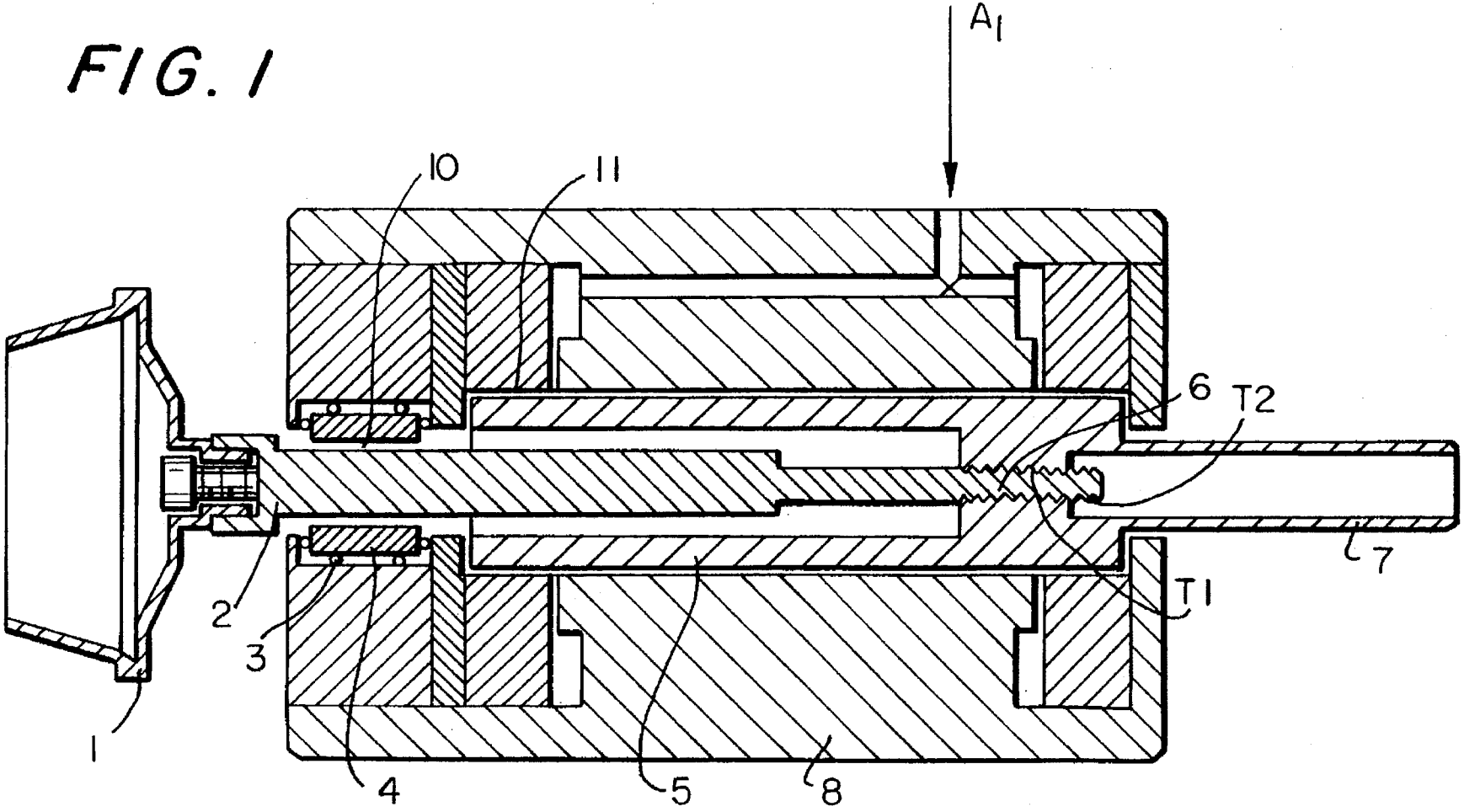
FIG. 1 shows a first embodiment of a spindle for a gas bearing for a rapidly rotating tool in accordance with the invention.

Referring to the accompanying drawings, the spindle in accordance with the invention as shown in FIG. 1 comprises a housing 8, an elongate, substantially cylindrical shaft 5 aerostatically supported in the housing 8 in both an axial and radial direction. The designs of aerostatic bearings are known in the art. The aerostatic bearing used here stands out because of its low air consumption, since the exhaust air used in the radial bearings is also used in the axial bearings. Air or another gas is introduced into the housing in the direction of arrow $A_1$ and flows in a clearance 11 defined between the housing 8 and the outer peripheral surface of the shaft 5, to function as a radial aerostatic bearing, and then between end surfaces of the shaft 5 and the housing 8, to function as an axial aerostatic bearing.

The shaft 5 is driven at one end 7 via drive means such as a tangential belt. A central bore is located in the shaft 5 at a side opposite end 7. An extension 2, which is also referred to as an extension rod, is attached at one end in a bottom of the bore in the shaft 5 by connection means such as a press-fit connection 6. The extension 2 is in form of a rod which is connected at an end opposite to the end attached to the bottom of the bore in shaft 5 to a spinning rotor 1, e.g., by means of a screw connection. The press-fit connection 6 between rod 2 and the bottom of the bore in shaft 5 is established through the fact that at least one of the rod 2 and the bore in shaft 5 is provided with threads T1, T2 (the press measure is about 0.2 mm to about 0.3 mm). The diameter of rod 2 increases in steps in the direction of the spinning rotor 1, i.e., it is smaller at the end connected to the bottom of the bore in shaft 5 than at the end to which the rotor 1 is connected. The smallest diameter near the location of the connection 6 between shaft 5 and rod 2 must be of such size as to be able to transmit with sufficient reliability the drive and brake moments to the spinning rotor 1, and must be small enough so that the first natural vibration of the rod 2 can be run through even at a relatively low rotational speed (it measures about 3 mm in this embodiment). The overall length of the rod 2 is approximately 20 times the smallest diameter.

At the end of the rod at which the spinning rotor 1 is attached, there is an additional radial bearing 4 with a bearing clearance 10 which is about ten times the clearance 11 of the aerostatic radial bearing, i.e., the distance between the outer peripheral surface of the shaft 5 and the opposed inner surface of the housing 8. This clearance 10 should be at least two times clearance 11. This bearing 4 is a grease-lubricated sliding bearing in the illustrated embodiment. A roller bearing with sufficient bearing clearance could be used as well. In order to achieve good damping of the bearing as the first natural vibration is run through, the sliding bearing 4 is suspended on O-rings 3 in the housing.

Since the spinning rotor 1 must be replaced every 10,000 hours of operation for reason of wear, it is no great effort to replace the greased and partly worn sliding bearing 4 at the same time. At this point in time, information is not yet available on the actual life of the sliding bearing 4.

The spindle is designed for a rotational speed of about 120,000 RPM. The first natural vibration of the rod 2 is run through already at a rotational speed of about 12,000 RPM. Thereafter, the spinning rotor runs in the supercritical vibration range, i.e., the inertia forces are always compensated for, and the forces exerted on the aerostatic bearing are low, even in the presence of great unbalance. The spinning rotor operates in the subcritical zone up to about 11,000 RPM.

Figure 2:
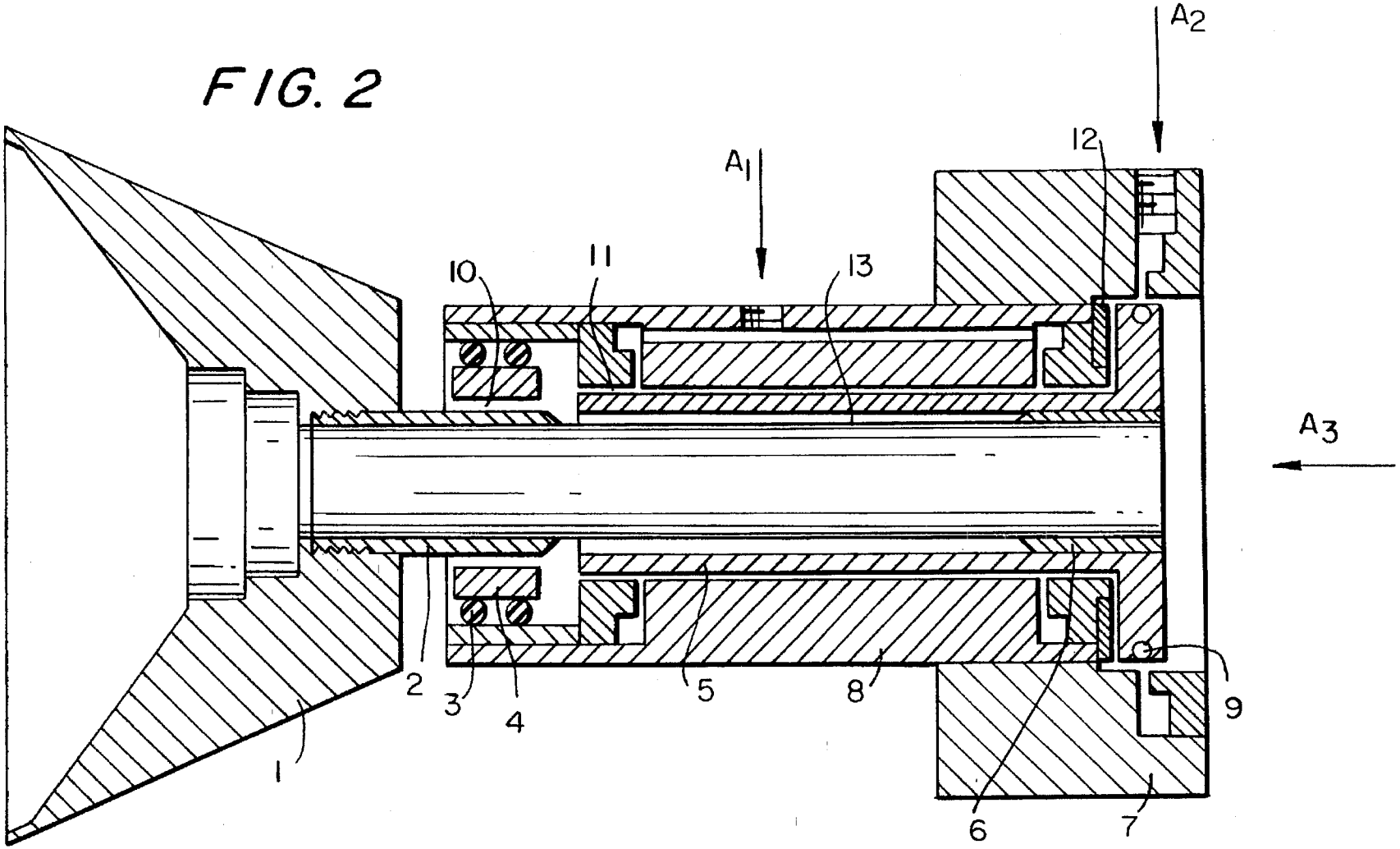
FIG. 2 shows a second embodiment of a spindle for a gas bearing for a rapidly rotating tool, which is a varnish atomizer in this embodiment, in accordance with the invention.

Referring now to the embodiment of the spindle in accordance with the invention as shown in FIG. 2, the spindle comprises a shaft 5 supported aerostatically in a radial direction in a housing 8 by the inflow of air or another gas in the direction of arrow $A_1$ into the housing and between an outer peripheral surface of the shaft 5 and the housing 8. Shaft 5 has an outwardly directed flange at one end thereof. The axial bearing comprises a combination of a permanent magnet 12 arranged in a position opposite the flange of the shaft 5 and the unilaterally effective aerostatic axial bearing which is provided with air coming from the radial bearing gap, i.e., the passage of air through a clearance between the flange of the shaft 5 and the housing 8. The configurations of aerostatic bearings are known in the state of the art. The aerostatic bearing used here stands out in particular because of low air consumption.

The shaft 5 is driven at its flanged end via drive means such as an air turbine 9 into which air is directed in the direction of arrow $A_2$. Shaft 5 includes a central bore and an extension 2 is attached to the inner circumferential surface at one end of the bore in shaft 5 by connection means such as a press-fit connection 6. A block 7 is arranged at the flanged end of the shaft 5 to surround the flange of the shaft 5.

The extension 2 is made in form of a substantially cylindrical pipe rod at the end of which a varnish atomizer 1 is attached by connecting means such as a screw connection. The varnish is passed to the atomizer 1 through the hollow interior of the shaft 5 in the direction of arrow $A_3$. The wall 13 of extension rod 2 is extremely thin between the location of the press-fit connection 6 and the location opposed to a bearing 4 of the extension rod 2 (about 0.08 mm) so that sufficient elasticity of the freely oscillating extension rod 2 may be ensured so that the natural vibration may be run through already in the speed range from about 6,000 to about 8,000 RPM. The thickness of the wall 13 of extension rod 2 increases again considerably in the direction of the end towards the varnish atomizer 1 in order to make support and detachable installation of the same possible. Thus, the extension rod 2 has a variable thickness.

The bearing 4 at the end of extension rod 2, where the varnish atomizer 1 is attached, has a clearance 10 which is ten times the bearing clearance 11 of the aerostatic bearing which in this case has a clearing of about 20 μm. This bearing 4 is in this case an oil-soaked sintered bronze sliding bearing. A roller bearing with sufficient bearing clearance could just as well be used. In order to achieve good damping of the bearing 4 as the first natural vibration is run through, the bearing 4 is suspended on O-rings 3 in the housing.

The spindle is designed for an operating speed of about 80,000 RPM. The first natural vibration of the extension rod 2 is run through already at about 7,000 RPM. Afterwards, the varnish atomizer 1 runs in the supercritical vibration zone, i.e., the inertia forces in the atomizer 1 are constantly compensated for and the forces exerted upon the aerostatic bearing are low, even when great unbalance masses are present.

Figure 3:
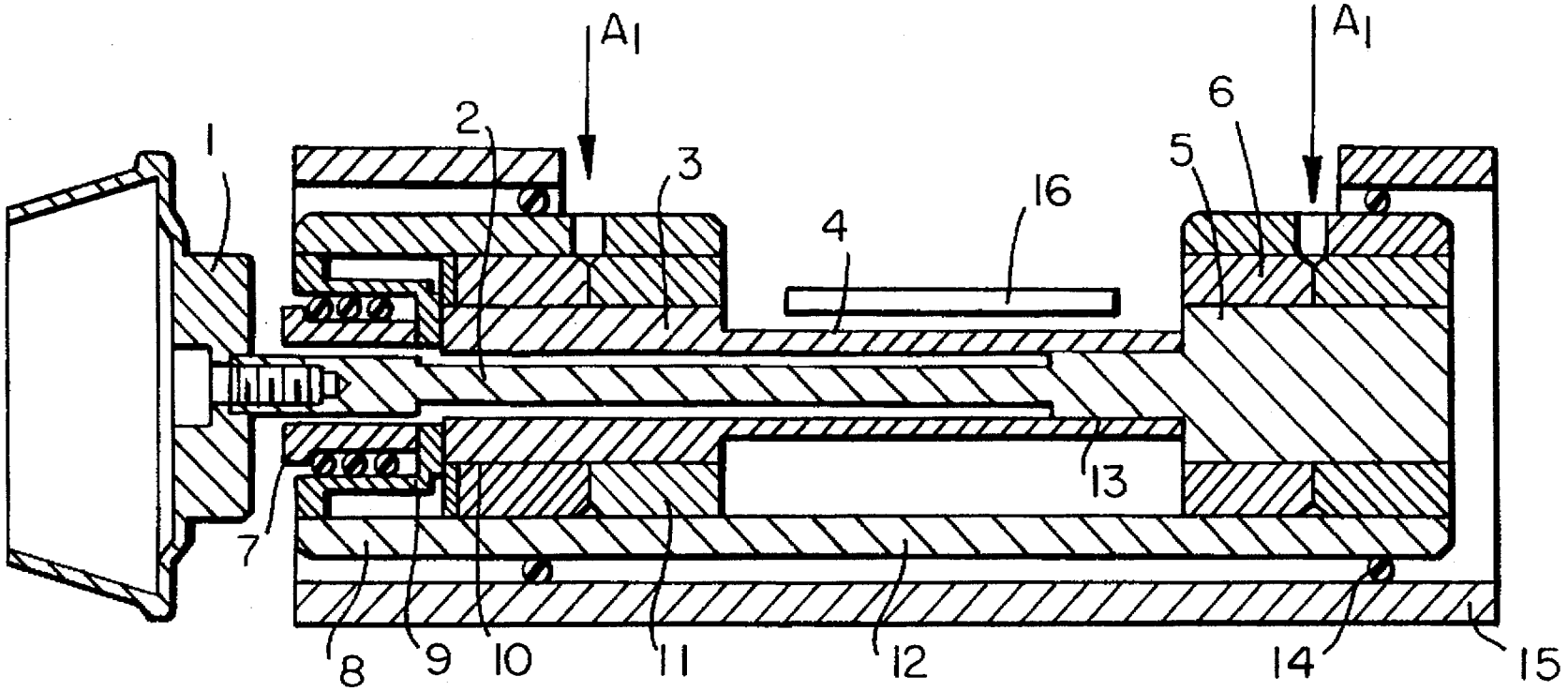
FIG. 3 shows a third embodiment of a spindle for a gas bearing for a rapidly rotating tool in accordance with the invention.

FIG. 3 shows another embodiment of the spindle bearing in accordance with the invention when applied in connection with a spinning rotor 1. The spinning rotor 1 is attached at the end of a freely oscillating extension 2 by means of a detachable connection. A sliding bearing 7 surrounds a portion of the extension 2 proximate to the end attached to the rotor 1 and limits the vibration excursions as the first natural vibration of the extension 2 is run through.

The housing 15 of the spindle includes a shaft which is supported aerostatically in radial and axial directions in the housing which comprises two bearing elements 3,5 which are connected to each other by a drive element 4. A flat belt 16 exerting radial forces runs over the drive element 4. The two bearing elements 3,5 of the shaft are coupled to each other by connecting means such as a press-fit connection 13 in the area of the drive element 4. The rear bearing portion of element 5 and the freely oscillating extension 2 are made in one part, i.e., integral with one another. On the rotor side of the shaft adjacent element 3, a disk 10 is attached by press-fit and is used for axial support in both directions. Each of two bearing housing elements 6,11 which house elements 5,3, respectively, comprises a bushing 8 into which two rings are pressed and between which a gap exists which is needed for the air supply of the aerostatic radial bearing. Each bearing element 6,11 has an air connection (represented by arrows $A_1$). The connecting element 12 of the two bearing elements 6,11 is configured in its geometry so that it is closely adapted to the load-dependent deformation of the drive element 4. The bearing elements 6,11 and the connecting element 12 are made in one piece, i.e., integral with one another, in the illustrated embodiment. Each bearing element 6,11 is attached on an O-ring 14 in the spindle housing 15. A bushing 9 is press-fitted into the forward bearing element 11 and is provided to support the axial bearing. The above-described sliding bearing 7 is suspended in this bushing by means of O-rings.

FIG. 4A shows an embodiment of the snap according to the invention which is used to connect the spinning rotor 1 to the end of the freely oscillating extension 2. A groove 25 is located on the conical end of the extension 2 and an elastically deformable ring 23 is inserted into the groove 25 (the ring being shown more clearly in FIG. 4B). The seat at the spinning rotor 1 is formed by two opposing cones which meet at the snap edge 26. In order to achieve greater elasticity of the ring 23, the ring circumference 24 is slit at one location (FIG. 4C).

Figure 5:
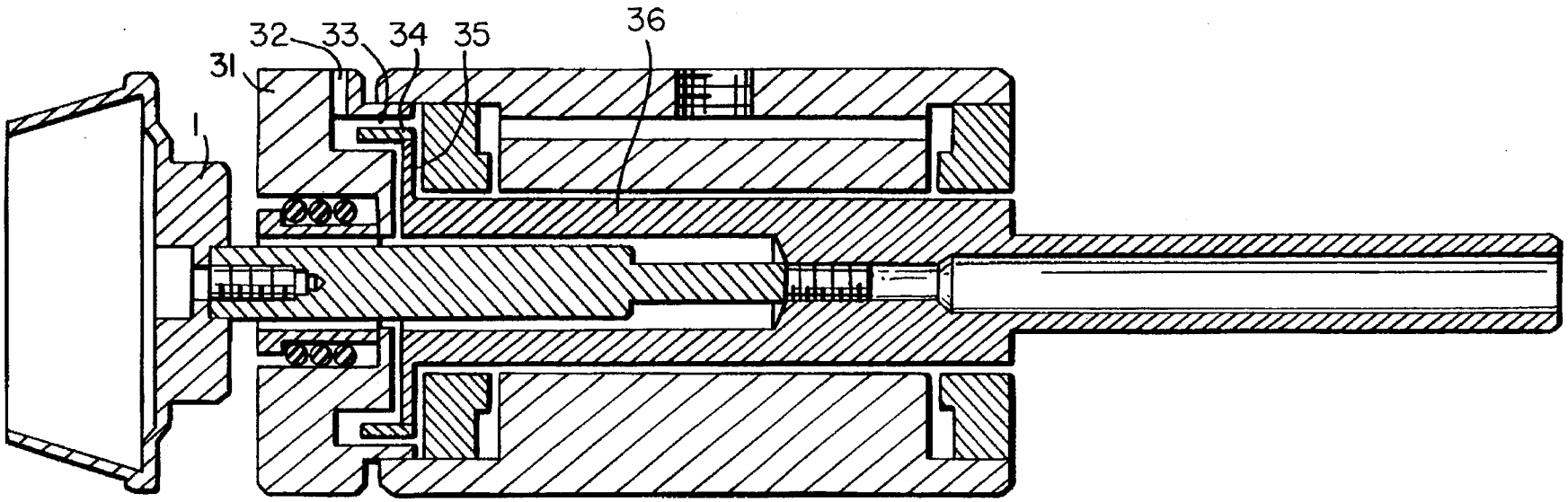
FIG. 5 shows an embodiment of a hydrodynamic braking device used in conjunction with the spindle in accordance with the invention.

FIG. 5 shows an embodiment of a hydrodynamic braking device used in conjunction with the spindle in accordance with the invention whereby an axially supported disk at the end of the shaft is used. A ring-shaped extension 34 is attached to the edge of a disk 35 which is flanged from a shaft 36 and provides axial support for the shaft 36. This extension 34, together with a portion of the brake housing 31, define a radial gap 33. Oil is pressed into this gap 33 through a bore 32. Liquid friction brakes the shaft 36 and the spinning rotor 1 until they stop. The ring-shaped extension 34 has a ratio wall thickness to width of at least 1:2.

Figure 6:
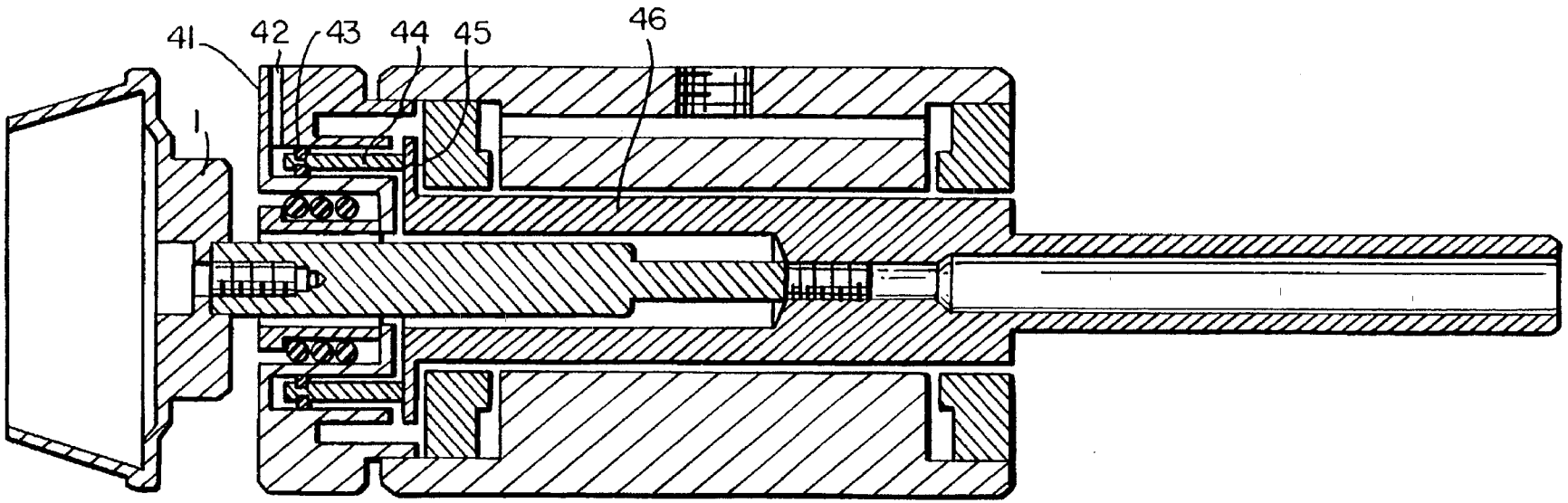
FIG. 6 shows another embodiment of a braking device used in conjunction with the spindle in accordance with the invention.

FIG. 6 shows another embodiment of a braking device used in conjunction with the spindle in accordance with the invention whereby an axially supported disk at the end of the shaft is used. The embodiment in FIG. 6 includes a pneumatically operated friction lining brake. In this brake, a disk 45 flanged from the shaft 46 and used for axial support of the shaft 46 is also used. A brake lining 44 is pressed on an axial surface on one side of the disk 45. The brake lining 44 is attached in the brake housing 41 by means of O-rings 43 so as to be capable of shifting. The brake lining 44 with the O-rings 43 and the brake housing 41 define a space which is supplied with compressed air via a bore 42 during braking. The axial force opposing the brake pressure is produced by the aerostatic axial bearing.

The examples provided above are not meant to be exclusive. Many other variations of the present invention would be obvious to those skilled in the art, and are contemplated to be within the scope of the appended claims.

I claim:

1. Spindle for gas bearing of a rapidly rotating tool, comprising a spindle housing, a rotatable elongate shaft supported in said spindle housing by radial gas bearing means in a radial direction of said shaft, a first bearing clearance being defined between said spindle housing and said shaft, an elongate extension rod having first and second ends, said extension rod being coupled at said first end to said shaft and unrestrained at said second end such that said extension rod is freely oscillatable from a coupling location of said first end of said extension rod to said shaft, said tool being coupled to said second end of said extension rod, and an extension rod bearing arranged at a region proximate said second end of said extension rod, a second bearing clearance being defined between said extension rod and said extension rod bearing, said second bearing clearance being at least twice said first bearing clearance.

2. The spindle of claim 1, wherein said shaft comprises a central bore in which said extension rod is situated, said extension rod being cylindrical and having a diameter which increases in a direction from said first end to said second end, the length of said extension rod being at least about four times the smallest diameter of said extension rod.

3. The spindle of claim 2, further comprising press-fit connection means for attaching said first end of said extension rod to said shaft, said connection means comprising threads arranged in said shaft proximate said bore and on said first end of said extension rod which is pressed into said bore.

4. The spindle of claim 2, wherein said shaft has a first end and a second, free end, further comprising drive means for rotating said shaft, said drive means being arranged in connection with said first end of said shaft, said radial bearing means being arranged at regions proximate said second, free end of said shaft and constituting an aerostatic radial bearing.

5. The spindle of claim 1, wherein said shaft comprises a central bore in which said extension rod is situated, said extension rod being drilled, further comprising press-fit connection means for attaching said first end of said extension rod to said shaft, a thickness of a wall of said extension rod increasing in direction from said first end to said second end.

6. The spindle of claim 1, further comprising connection means for detachably connecting said tool to said extension rod.

7. The spindle of claim 6, wherein said connection means comprise a snap formed between said tool and said extension rod.

8. The spindle of claim 7, wherein said snap comprises a substantially cylindrical elastic ring, said tool and said extension defining a conical seat therebetween in which said snap is operative.

9. The spindle of claim 8, wherein said elastic ring includes at least one slit in its circumference.

10. The spindle of claim 1, further comprising drive means for rotating said shaft, said radial bearing means comprising first and second radial bearing elements each arranged at a separate location on said shaft, said drive means being operative on said shaft at a location between said locations at which said radial bearing elements are arranged.

11. The spindle of claim 10, wherein at least a portion of said first radial bearing element is in engagement with at least a portion of said second radial bearing element.

12. The spindle of claim 10, further comprising a disk attached at an end of said shaft proximate to said first or said second radial bearing element, said disk constituting aerostatic axial support means for supporting said shaft in an axial direction.

13. The spindle of claim 12, wherein said disk and said shaft are integral with one another and constitute a single piece.

14. The spindle of claim 12, further comprising connecting means for connecting said disk to said shaft, said connecting means comprising a press-fit.

15. The spindle of claim 12, further comprising connecting means for connecting said disk to said shaft, said connecting means comprising a weld.

16. The spindle of claim 1, wherein said shaft and said extension rod are integral with one another and constitute a single piece.

17. The spindle of claim 1, wherein said shaft has a flanged end, further comprising a disk arranged in said housing in opposed relationship to said flanged end of said shaft, said disk constituting an aerostatic axial support for said shaft, and a ring-shaped permanent magnet attached to said disk and facing said flanged end of said shaft.

18. The spindle of claim 1, further comprising a disk attached at an end of said shaft, said disk constituting an aerostatic axial support for said shaft, and a ring-shaped extension arranged at an edge of said disk, said ring-shaped extension and said housing defining a radial gap.

19. The spindle of claim 18, wherein said housing comprising a bore leading from an exterior of said housing into said radial gap for passage of fluid between said radial gap and the exterior of said housing.

20. The spindle of claim 18, wherein said ring-shaped extension has a ratio wall thickness to width of at least 1:2.

21. The spindle of claim 1, further comprising a disk attached at an end of said shaft, said disk constituting an aerostatic axial support for said shaft, and a ring-shaped brake lining arranged on said disk, said brake lining being axially movable in said housing.

22. The spindle of claim 21, further comprising rubber rings for suspending said ring-shaped brake lining, said rubber rings and said brake lining sealing a space in said housing which is intermittently fed compressed air via a bore leading into said space from an exterior of said housing.

23. The spindle of claim 1, wherein said tool is an open-end spinning rotor, said spindle constituting an aerostatic bearing arrangement of said rotor.

* * * * *